US011329354B1

(12) United States Patent
Tsironis

(10) Patent No.: US 11,329,354 B1
(45) Date of Patent: May 10, 2022

(54) ANTI-SKEWING IMPEDANCE TUNER

(71) Applicant: Christos Tsironis, Dollard-des-Ormeaux (CA)

(72) Inventor: Christos Tsironis, Kirkland (CA)

( * ) Notice: Subject to any disclaimer, the term of this patent is extended or adjusted under 35 U.S.C. 154(b) by 0 days.

(21) Appl. No.: 17/002,446

(22) Filed: Aug. 25, 2020

(51) Int. Cl.
*H01P 1/00* (2006.01)
*H01P 3/10* (2006.01)

(52) U.S. Cl.
CPC . *H01P 1/00* (2013.01); *H01P 3/10* (2013.01)

(58) Field of Classification Search
CPC ..... H01P 1/00; H01P 3/10; G01R 21/2601; G01R 27/32
USPC ..... 333/109, 110, 111
See application file for complete search history.

(56) References Cited

U.S. PATENT DOCUMENTS 9,625,556 B1 * 4/2017 Tsironis ..... G01R 27/32

OTHER PUBLICATIONS

"Computer Controlled Microwave Tuner, CCMT", Product Note 41, Focus Microwaves Inc. 1998.
Stepper motors [online], Wikipedia [retrieved on Jul. 3, 2020]. Retrieved from Internet <URL: https://en.wikipedia.org/wiki/Stepper_motor>.

* cited by examiner

*Primary Examiner* — Rakesh B Patel
*Assistant Examiner* — Jorge L Salazar, Jr.

(57) ABSTRACT

A slide screw tuner uses a tuning probe that penetrates into the slot of the slabline inclined towards the test port, in order to compensate for the capacitive skewing of the angle of the reflection factor Γ. This anti-skewing effect is done by splitting the mobile combo carriage into a fixed and a rotating section, held together by a center pin that allows an adjustable inclination. The linearized trajectory of Γ improves the accuracy of interpolation between calibration points.

3 Claims, 8 Drawing Sheets

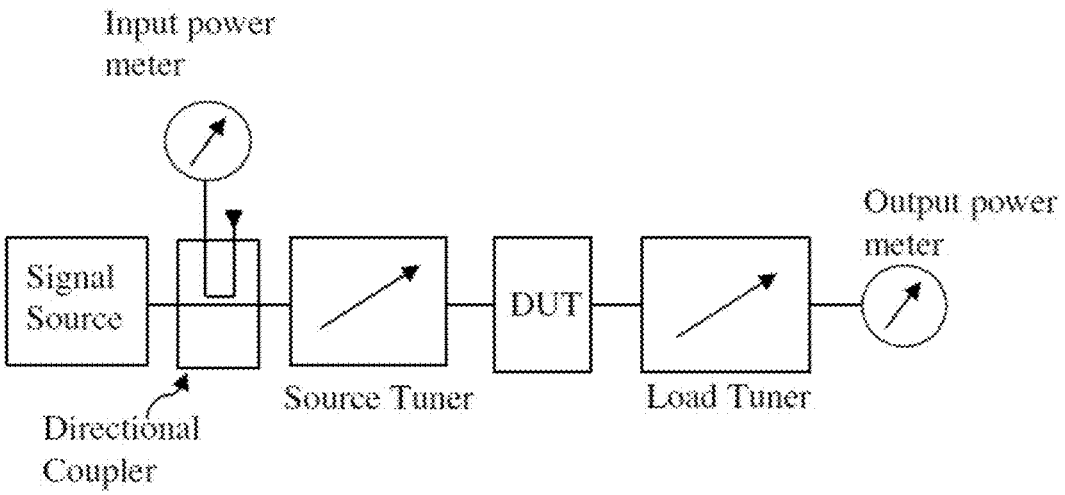
FIG. 1: Prior art

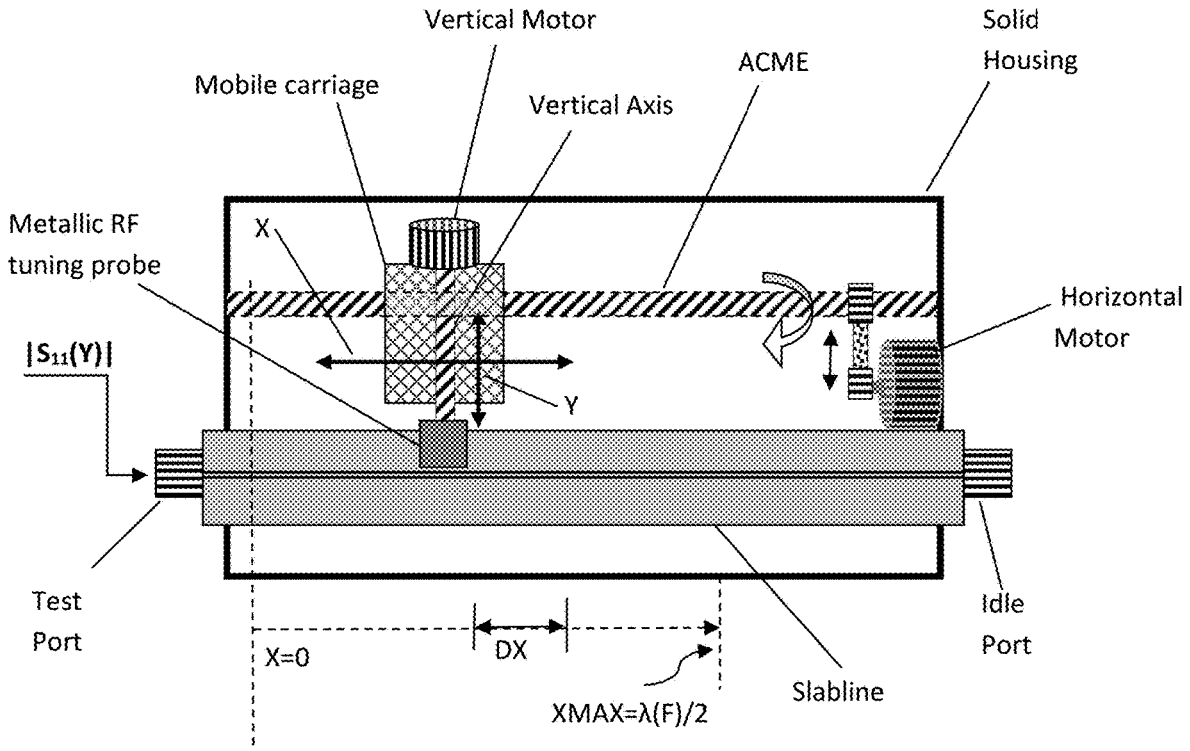
FIG. 2: Prior art

FIG. 3A: Prior art
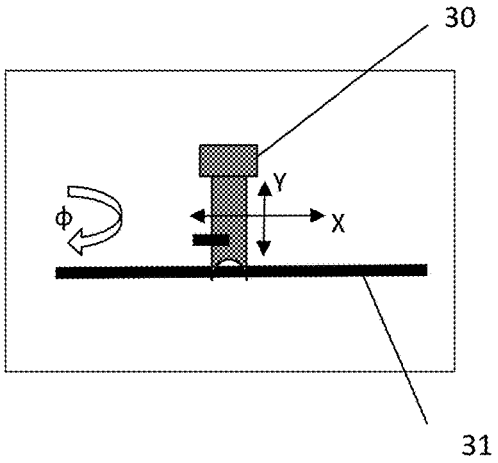
FIG. 3B: prior art
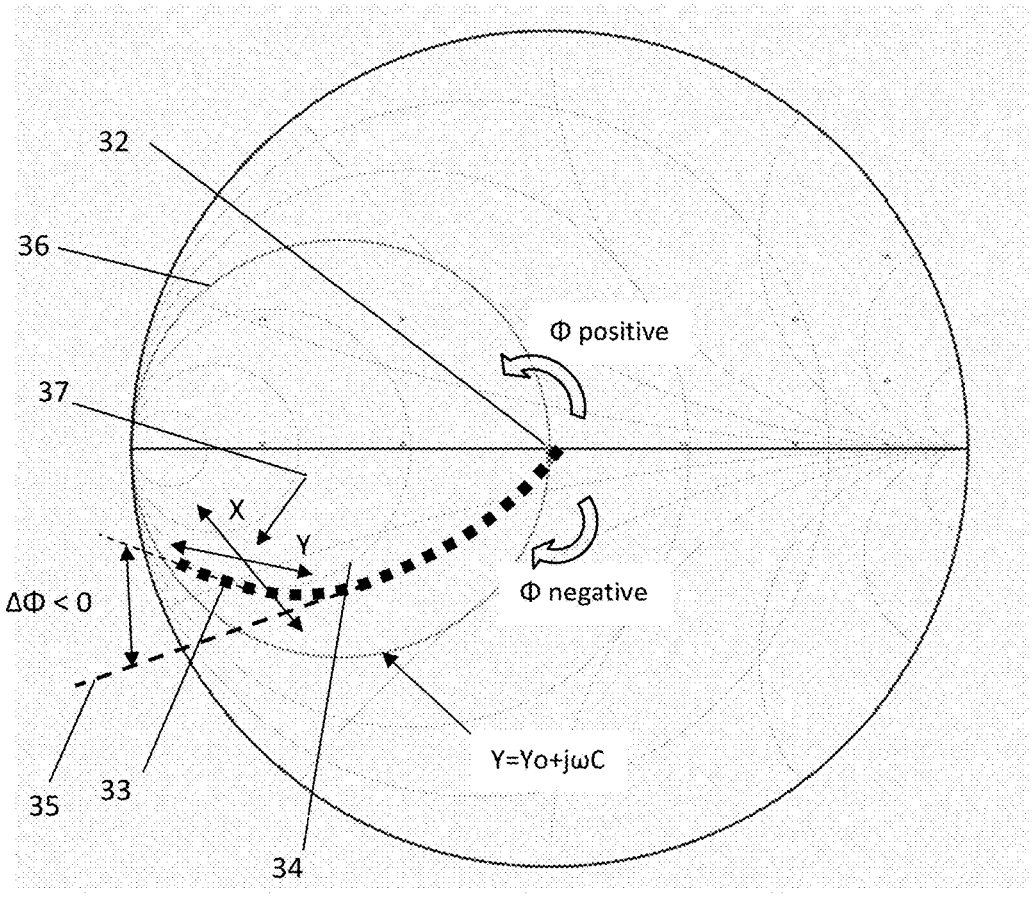

FIG. 5: Prior art

ANTI-SKEWING IMPEDANCE TUNER

PRIORITY CLAIM

Not Applicable.

CROSS-REFERENCE TO RELATED ARTICLES

1. "Computer Controlled Microwave Tuner—CCMT", Product Note 41, Focus Microwaves Inc., January 1998.
2. Stepper motors [online], Wikipedia [retrieved on 2020 Jul. 3]. Retrieved from Internet <URL: https://en.wikipedia.org/wiki/Stepper_motor>.
3. Tsironis C, U.S. Pat. No. 9,625,556, "Method for calibration and tuning with impedance tuners".

BACKGROUND OF THE INVENTION

Modern design of high-power microwave amplifiers and oscillators, used in various telecommunication systems, requires accurate knowledge of the active device's (microwave transistor's) characteristics. Source- and Load-pull are measurement techniques used for this characterization employing microwave impedance tuners (see ref. 1) and other microwave test equipment. The microwave tuners are using the slide-screw technology and create the conditions (microwave impedances) under which the Device Under Test (DUT, or transistor) is tested. This invention relates to the tuning behavior of such a slide screw impedance tuner.

A typical load pull measurement system is shown in FIG. 1. The tuners and the overall test system are controlled by a control computer (not shown), which is connected to the tuners and the test equipment using control cables. The electro-mechanical slide screw tuners (see ref. 1, FIG. 2) use adjustable metallic mechanical obstacles (RF tuning probes or slugs) inserted vertically into the transmission media (slotted low loss airlines) of the tuners to reflect part of the power coming out of the device under test (DUT) and create this way adjustable reflection factors corresponding to microwave impedances presented to the DUT in order to perform the tests. The transmission media of the tuners are made using a low loss slotted coaxial airline or parallel plate airline (slabline), which has a, typically, cylindrical center conductor, a test port and an idle port. The tuners are built into a solid, torque resistant, housing (box), FIG. 2, and include: At least one mobile carriage which slides horizontally along the slabline (X) between a zero (X=0) reference position and up to one half a wavelength $X=\lambda/2$ at the lowest frequency of tuner operation, to allow a 360° reflection factor phase control; the mobile carriage holds the radio frequency (RF) metallic tuning probe on a vertical axis; both carriage and tuning probe are controlled by electrical stepper motors (see ref. 2) ensuring the horizontal and vertical movement of the carriage (X) and the probe (Y). The motors are controlled by an electronic control board, which communicates with the system controller. The probe is attached to a precision vertical axis, controlled by a first (vertical) stepper motor; the ACME lead screw, engages the mobile carriage, is responsible for its horizontal movement and is controlled by a second (horizontal) stepper motor using a transmission gear, made, typically, using a set of pulleys and a timing belt drive (not shown in the drawing) (FIG. 3); the two pulleys and the timing belt form a gear system. In general, the tuner calibration and tuning mathematics (see ref. 3) use generic motor steps and not physical distances (millimeters or micrometers) to describe the tuner movement. Each motor step corresponds to a different physical probe and carriage movement increment according to the previously mentioned mechanical parameters.

BRIEF SUMMARY OF THE INVENTION

Control of the reflection factor phase Φ is created by the tuner through horizontal movement of the carriage and the partly or fully inserted tuning probe (see ref. 1). Control of the amplitude of the reflection factor is created by the penetration of the probe into the slot of the slabline and its proximity and capacitive coupling to the center conductor. The capacitive coupling with the center conductor creates a capacitance C that increases hyperbolically with the vertical position of the tuning probe as the probe approaches the center conductor (FIG. 3). This nonlinear increase creates a negative slope (skewing) 33 of the reflection factor, which complicates the interpolation algorithm, which is based on cartesian coordinates X, and Y used in tuning mathematics (see ref. 3, column 5, lines 61-67 and column 6, lines 1-5). This problem is alleviated by a modified tuner mechanics disclosed in this invention, having the tuning probe moving closer to the test port, as it moves closer to the center conductor, thus creating a positive phase change to compensate for the negative phase skewing ΔΦ (33 in FIG. 3B).

BRIEF DESCRIPTION OF THE DRAWINGS

The invention and its mode of operation will be better understood from the following detailed description when read with the appended drawings in which:

FIG. 1 depicts prior art, a block diagram of a load pull measurement setup, in which electro-mechanical impedance tuners are used to manipulate the source and load impedances presented to the DUT.

FIG. 2 depicts prior art, a front view of a slide screw tuner and associated components and definitions.

FIG. 3A through 3B depict prior art: FIG. 3A depicts schematically the tuning probe and its movement relative to the center conductor; FIG. 3B depicts the trajectory and skewing of the reflection factor as the tuning probe approaches the center conductor.

DETAILED DESCRIPTION OF THE INVENTION

Figure 5:
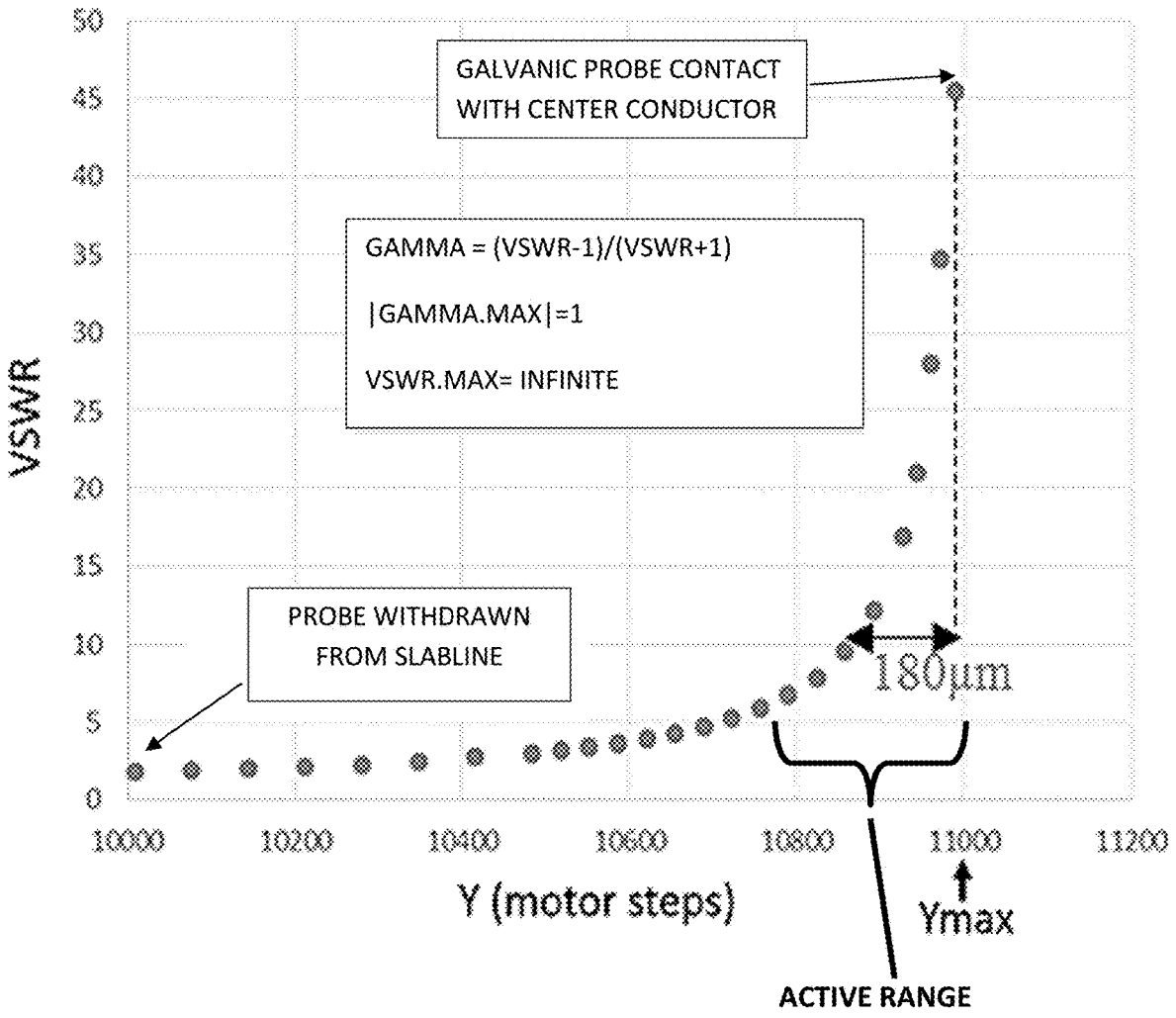
Figure 7:
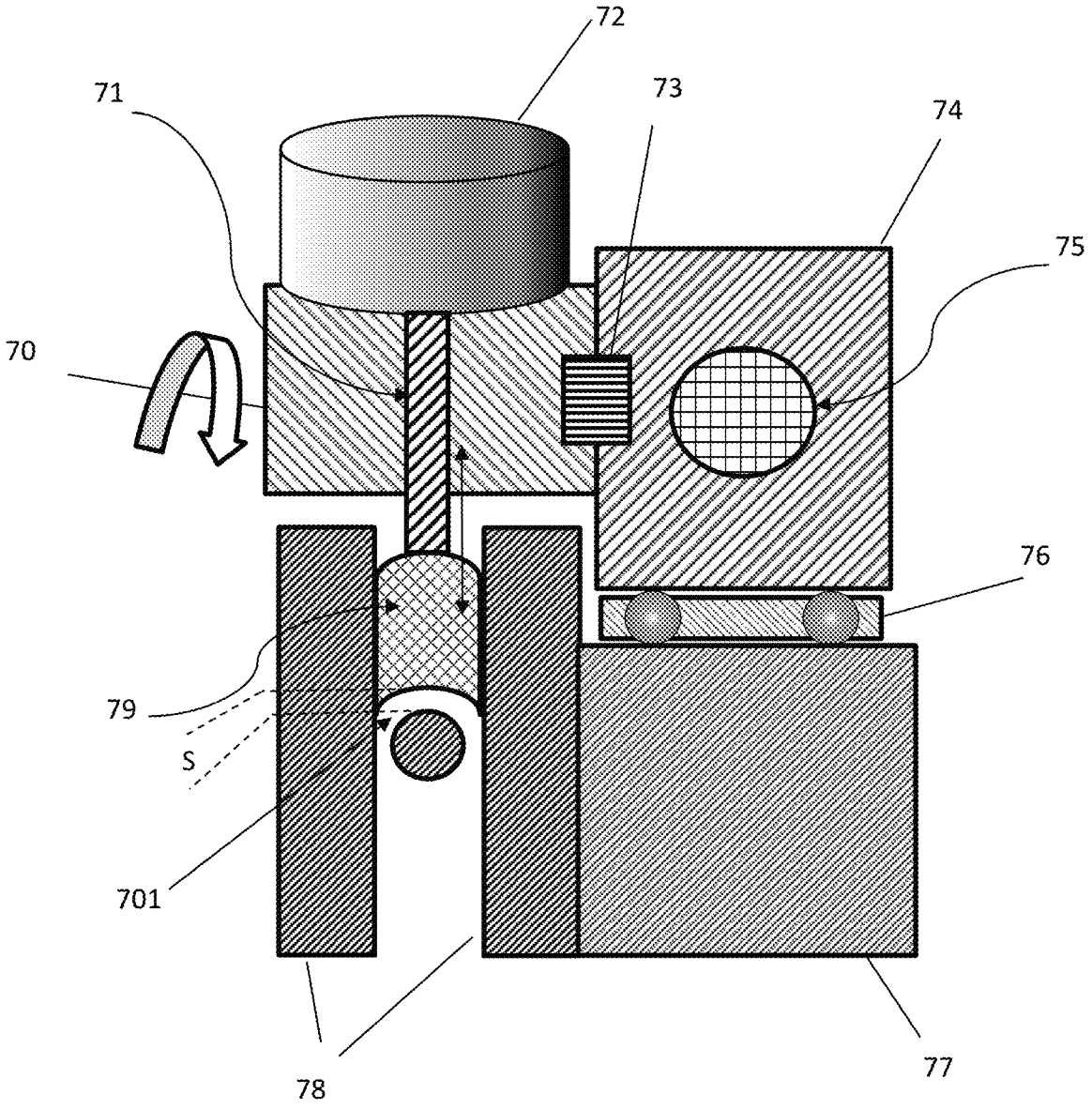
FIG. 7 depicts cross section of mobile combo carriage with fixed section and rotating section holding the tuning probe.

Beyond field deformation by the insertion of the tuning probe 30 (FIG. 3A) the major portion of skewing 33 is due to the hyperbolic increase of the capacitance between the tuning probe 30 and the center conductor 31 (area 701 in FIG. 7). The capacitance changes with the inverse of the gap S between center conductor and tuning probe: $C=\varepsilon_0*A/S$, wherein A is the effective surface between the probe and the center conductor (FIG. 5). Starting at the center of the Smith chart 32 and as the probe moves towards the center conductor the gap S shrinks and the capacitance C increases. The nonlinear change causes the 33 trajectory (FIG. 3B) to skew and not to follow the circles 34, 36 for linear change of the parallel susceptance $Im(Y)=j\omega C$ as a function of either frequency ($\omega=2*\pi*F$) or capacitance C. The skewing creates a negative phase change ($\Delta\Phi$) between the linear extrapolation 35 and the actual trajectory 33. The skew also creates a far from orthogonal response 37 of the $\Gamma$ trajectory as a function the cartesian controlling stimuli X and Y of the tuning probe. This stretches the Lagrange interpolation used for interpolating between calibration points (see ref. 3, col. 5, lines 64-67 and col. 6, lines 1-3), resulting in inaccuracies at very high skewed r. If during vertical movement of the tuning probe it also moves towards the test port 44, then the phase will increase (turn anti-clock-wise) 80 and compensate the skewing effect 81 as shown in FIG. 8.

Figure 4:
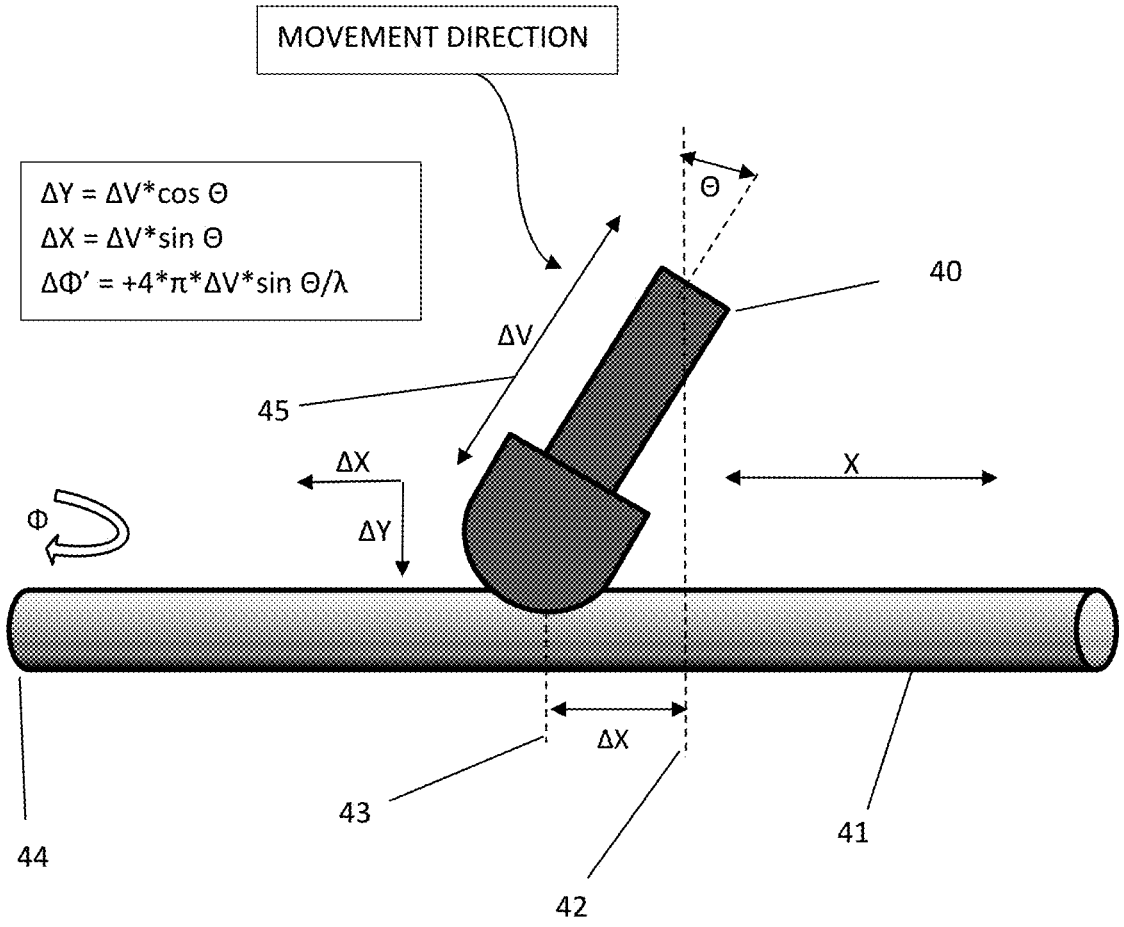
FIG. 4 depicts the inclined movement of the tuning probe to create anti-skewing effect.
Figure 6:
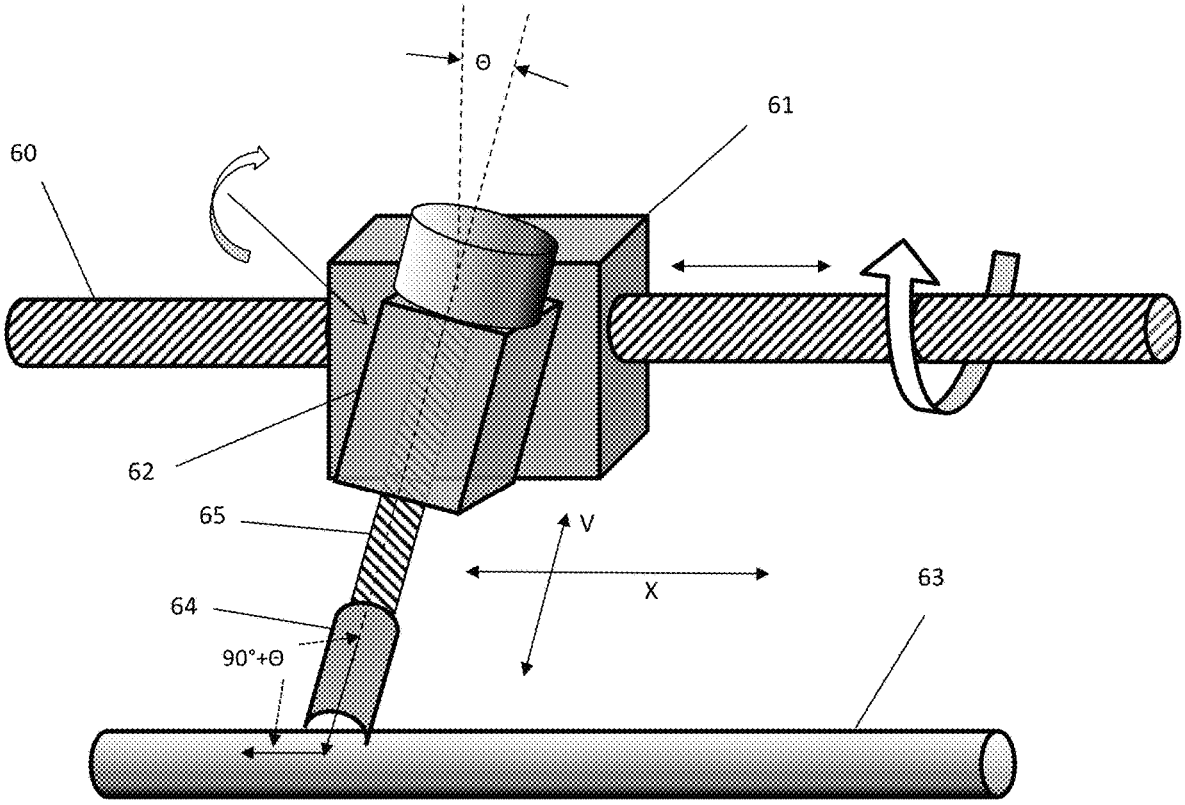
FIG. 6 depicts movement of mobile combo carriage and inclined tuning probe.
Figure 8:
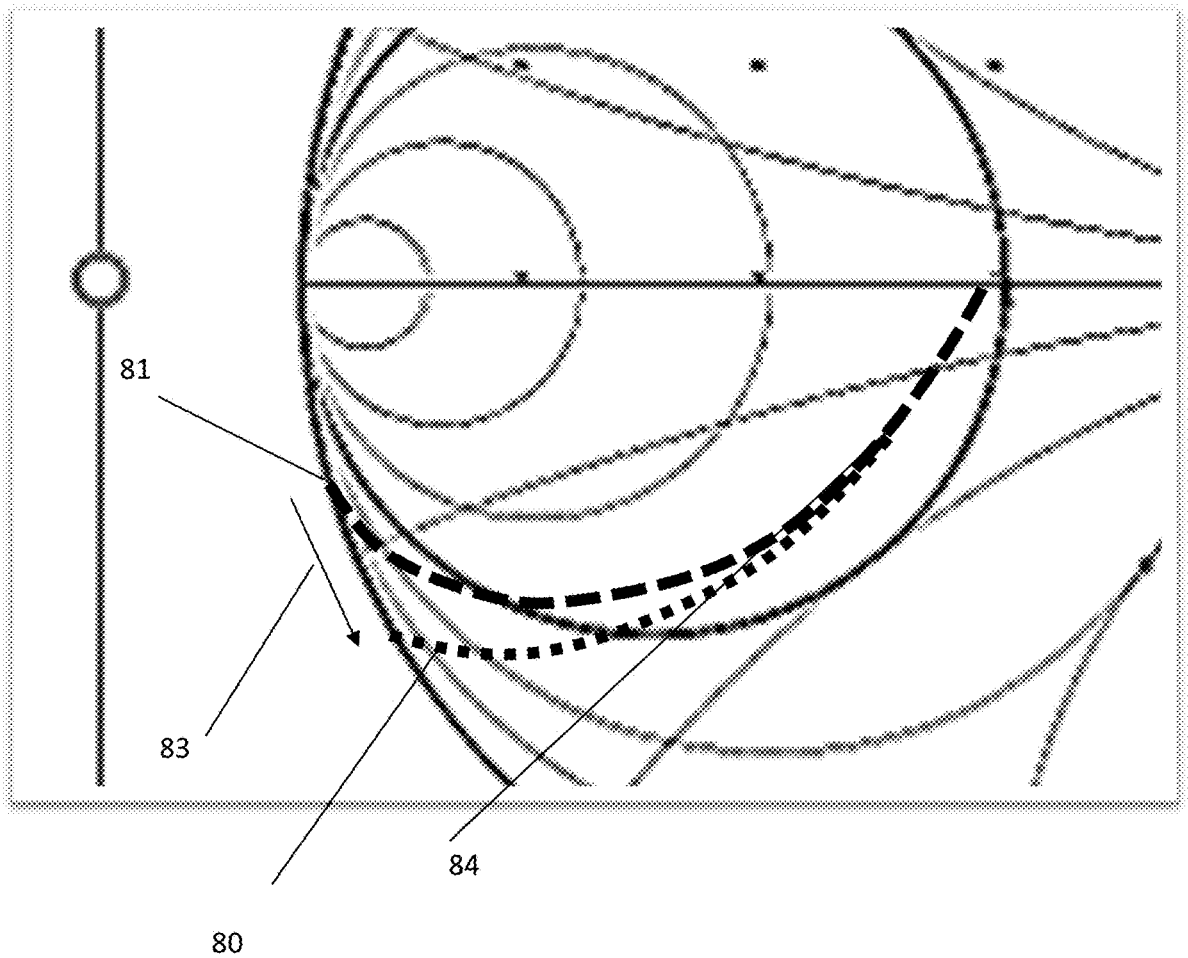
FIG. 8 depicts de-skewing effect of the inclined tuning probe.

The mechanism is implemented as shown in FIGS. 4, 6 and 8. FIG. 4 shows the principle of anti-skewing: the tuning probe 40 is inclined by the angle $\Theta$ against the prior art vertical direction 42. In order to avoid mechanical conflict with the center conductor 41 when coming in close proximity, the tip of the tuning probe is rounded in a semi-circular form profile, but keeps the basic concave bottom form of prior art probes, as can be seen in area S of FIG. 7. As the probe 40 moves along the axis 45 (V) its closest point to the center conductor also moves towards the test port 44. Following the relation $\Phi(\text{rad})=4*\pi*X/\lambda$, or $\Phi(°)=2.4*X(\text{mm})*F(\text{GHz})$ this means that for a vertical movement $\Delta V=0.5$ mm and an angle $\Theta=30°$, at F=10 GHz the anti-skewing phase increase is $\Delta\Phi=2.4*(0.5\ \text{mm}*\sin(30°)*10(\text{GHz}=6°)$. Anti-skewing increases with the angle $\Theta$ and the frequency F. The dimensions $\Delta V$ and $\Delta X$ between limits 42 and 43 shown in FIG. 4 are drawn exaggerated only for understanding the concept. In reality the movements are differentially small but in the same proportions, as shown in the calculations.

The anti-skewing structure is shown in FIG. 6. The mobile combo carriage includes two sections, a fixed section 61 and a rotating section 62 inclined by the angle $\Theta$ against the vertical. The rotation plan of the inclined section is parallel to the slot of the slabline and the center conductor 63. Both sections are attached to each-other using a center pin 73 (shown in FIG. 7). The angle between the sections is held normally by surface friction or by adding a (not shown) fixation screw on the pin. The vertical axis 65, that holds the tuning probe 64, moves along the angle $\Theta$ towards the center conductor 63. The fixed portion 61 of the combo carriage includes an internal thread that is engaged with the ACME lead screw 60, which controls its horizontal position X along the slabline 78 and the center conductor 63.

The combo carriage and control are shown in FIG. 7 in a cross section. The fixed section 74 slides on rollers 76 along the slabline 78 on block 77 controlled by the ACME lead screw 75. The rotating section 70, which carries the vertical axis 71, the vertical motor 72 and the tuning probe 79 are anchored against the fixed section 74 using the pin 73, and can be rotated on a plan parallel to the center conductor. The pin 73 allows section 70 to be inclined (0) against section 74 and is held in position by surface friction between the blocks 70 and 74. If needed, a set screw may be added against the pin 73 to better secure the inclination.

The slide screw tuner with anti-skewing capacity has been disclosed using a preferred embodiment. Obvious alternatives, though imaginable, shall not impede on the validity of the present invention.

What is claimed is:

1. A slide screw impedance tuner comprising, a low loss slotted transmission airline (slabline) having a test port, an idle port and a center conductor between the test and idle ports, and at least one remotely controlled mobile combo carriage sliding horizontally along the slabline, controlled by an Acme lead screw, and an electronic motor control board;

said at least one remotely controlled mobile combo carriage comprising one fixed section and one section rotating against the fixed section on a plan parallel to the center conductor of the slabline, wherein a horizontal position of the one fixed section is controlled by the Acme lead screw, and wherein the one rotating section holds a vertical axis and is linked with the one fixed section using a center pin;

and wherein the vertical axis holds a metallic tuning probe having a stem held by the vertical axis and a bottom section insertable into a slot of the slabline.

2. The slide screw impedance tuner of claim 1 wherein a rotation angle between the one fixed section and the one rotating section is adjustable.

3. The slide screw impedance tuner of claim 1 wherein the bottom section of the tuning probe has a concave periphery with semi-circular profile, and wherein a channel of the concave bottom section is parallel to the center conductor.

* * * * *